United States Patent [19]

Mitchell

[11] Patent Number: 4,724,327

[45] Date of Patent: Feb. 9, 1988

[54] LUMINESCENT WELT CORD

[75] Inventor: Wilburn H. Mitchell, Fulton County, Ga.

[73] Assignee: Harry I. Leon, Atlanta, Ga.

[21] Appl. No.: 869,216

[22] Filed: Jun. 2, 1986

[51] Int. Cl.[4] ..... F21K 1/00

[52] U.S. Cl. ..... 250/484.1; 250/462.1; 428/123; 428/690

[58] Field of Search ..... 250/488.1, 485.1, 484.1, 250/483.1, 462.1; 428/123, 690

[56] References Cited

U.S. PATENT DOCUMENTS 2,382,355 8/1945 Warren, Jr. ..... 250/462.1
2,436,182 2/1948 Schmidling ..... 250/488.1

FOREIGN PATENT DOCUMENTS 1176468 8/1964 Fed. Rep. of Germany ..... 428/123
0003473 of 1915 United Kingdom ..... 250/484.1

*Primary Examiner*—Janice A. Howell
*Assistant Examiner*—Constantine Hannaher
*Attorney, Agent, or Firm*—V. L. Leon

[57] ABSTRACT

A welt having a strip of transparent plastic material which is folded over a cord or rope saturated with a phosphorescent paint so as to encase the cordage and protect both it and the paint. The welt, after being exposed briefly to an ordinary bright light, remains luminous for time intervals on the order of hours, allowing portions of the welt to be seen in the dark.

3 Claims, 4 Drawing Figures

Fig. 1.
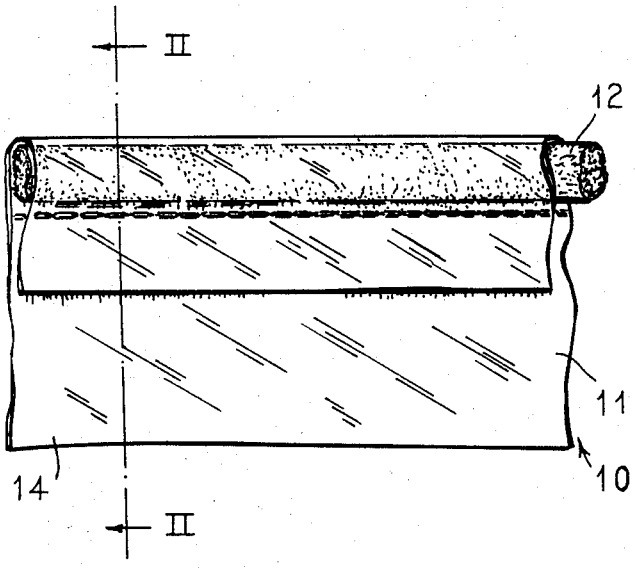
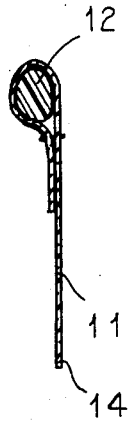
Fig. 2.
Fig. 3.
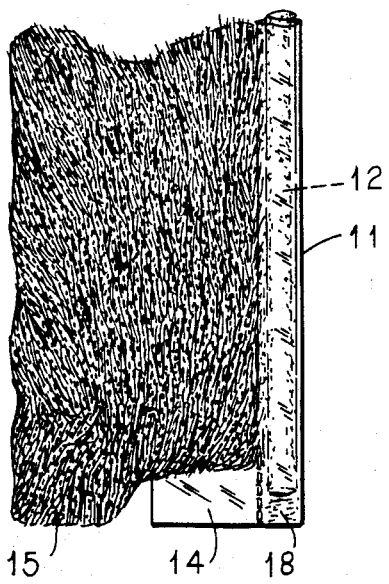
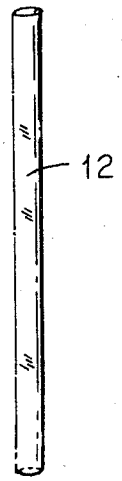
Fig. 4.

LUMINESCENT WELT CORD

BACKGROUND OF THE INVENTION

1. Field of the Invention

The present invention relates generally to strips of material which are folded over a cord and placed at the edge or seam of a piece of upholstery such as a slip cover, carpet or the like to reinforce and to decorate it.

2. Description of the Prior Art

As is well-known, phosporescent paints once they have been excited remain luminous with a soft, slowly decaying radiation. Such paints can generate a useful level of luminous flux for several hours when placed in the dark after having absorbed sunlight or artificial light of a suitable wavelength. Although they do not require continuous irradiation to maintain such levels, the initial, most intense luminescence can only be restored by once again exposing the paints to either a natural or an artificial light.

In the event of a blackout or other emergency in which the normal electric power supply is cut off, objects coated with phosphorescent paint will glow for extended periods of time, helping to demarcate walkways, exit doors and the like if they are so coated. Phosphorescent paints have also been employed for ornamentation; such applications include the once popular artifice of decorating wallpapers and lampshades with phosphorescent designs which, after the light is switched off, remain luminous for hours.

In phosphorescent paints, the luminescent material or phosphor, which is almost exclusively a zinc sulfide or alkaline earth sulfide, is formed of relatively large particles. Contrary to standard paint practice, which is to get the pigment ground as finely as possible, the phosphors in these paints are ordinarily reduced to grains of not less than about 0.1 mm diameter, corresponding to 200 mesh, since grinding the phosphor further decreases its luminous efficiency. Because of the coarseness of the grains, phosphorescent coatings on an exposed surface tend to flake off, requiring frequent replacement. Although in some cases this problem can be obviated by applying a transparent overcoat as soon as the surface is dry, the protective layer itself is easily eroded and must be repeatedly renewed. Moreover, protecting the paint with an overcoat is not always feasible and is especially difficult to achieve in the case of phosphorescent designs on carpets, upholstery and other flexible surfaces. When an overcoat is bonded to such surfaces, it tends to crack after they have been repeatedly flexed.

Not only must a phosphorescent coating be protected from erosion but also the phosphor in the paint must be shielded from the oxidizing action of the atmosphere and from moisture. An overcoat, if feasible, can do both, extending the lifetime of a coating by reducing the rate of oxidation of its phosphor and by keeping out water as well as by minimizing flaking. On the other hand, if no overcoat is provided, chemical attack by the atmosphere on the phosphor can result in a coating losing its capacity to phosphoresce in six to twelve months.

SUMMARY OF THE INVENTION

The primary object of this invention is to provide an inexpensive, long-lived device for decorating and for strengthening a piece of upholstery along its seams and edges, with the contours of the piece when it is situated in a darkened room or other enclosure or out-of-doors after dark being outlined in a low level of luminous flux for several hours after the piece has been exposed either to light from an ordinary electric lamp or to sunlight.

A further object is to provide a wear-resistant device for demarcating the edges of a carpet along a hallway or within a stairwell which has been abruptly plunged into darkness due to an electric power outage.

A still further object is to provide a device which can be permanently attached to a piece of furniture or to its slipcover to enable persons to perceive its overall location during a blackout or for several hours after lights are out at night.

According to the present invention, means for decorating a piece of upholstery and demarcating its whereabouts in an otherwise darkened setting for at least a few hours after lights have been extinguished includes a welt in which a cord saturated with a phosphorescent paint is encased in a strip of flexible, transparent plastic material so that the strip forms a thick-walled, tight-fitting enclosure about the cord to reduce not only the likelihood of its being eroded by flaking or by abrasion but also to diminish the rate of interchange between the atmosphere and any gases evaporating from the paint. At the same time, the strip, which is not bonded to the cord, can be stretched independently of it, helping to insure that the thick walls of the strip continue to provide an air-sealed, crack-free enclosure for maintaining an environment surrounding the paint which tends to preserve its flexibility and which contains a lower concentration of oxidizing agents and of water capable of attacking the phosphor than if the paint, upon drying, were left exposed to the atmosphere.

Other objects and advantages will appear from the following description of an example of the invention, when considered in connection with the accompanying drawings, and the novel features will be particularly pointed out in the appended claims.

BRIEF DESCRIPTION OF THE DRAWINGS

FIG. 1 is an elevation view of a fragmentary section of a welt embodying the present invention on an enlarged scale;

FIG. 2 is a cross-section II—II with respect to FIG. 1, showing a transverse section of the welt;

FIG. 3 is a plan view of a fragmentary section of a carpet to the edge of which a welt according to FIG. 1 has been attached; and FIG. 4 is the same view as in FIG. 3 but inside a darkened room within a few hours of the lights therein having been extinguished.

Like reference characters indicate corresponding parts throughout the several views of the drawings.

DESCRIPTION OF THE PREFERRED EMBODIMENT

As illustrated in the drawings, a welt, designated generally by the numeral 10, embodying the present invention comprises an elongated, rectangular strip 11 of flexible, transparent plastic material such as vinyl, polyethylene or the like. One of the longer edges of the strip 11 is first folded over a cord 12 and then stitched against it with nylon thread to form a close-fitting enclosure about the cord but one in which the cord slides independently of the walls of the strip as it is being stretched. Alternately, the strip 11 is formed of a shrinkable, transparent plastic material; and the sides of the strip are joined together by heat treatment so that when the strip cools, a close fit is achieved between the strip and the cord. In the preferred embodiment, the band 14 extends transversely from the longitudinal centerline of the strip 11 for the length thereof, forming an overlay to facilitate the attachment of the welt 10 within a seam or along the edge of a piece of upholstery such as a carpet (FIG. 3). By way of example, the width of the overlay measures from 1 to 2 inches.

The cord 12 is preferably 2-ply cotton thread but can range in thickness from 3/16 inch to 2½ inches. It is important that the cord 12 be made of cotton or of another natural fiber capable of absorbing a paint vehicle such as an acrylic resin or water for luminous acrylic and latex paints, respectively. The cord 12 is initially soaked in a phosphorescent paint to the point of saturation and then allowed to dry. If the cord 12 is saturated with a luminous acrylic paint, the cord takes only about 3 to 5 minutes to dry. Saturating the cord 12 with paint insures that some of it will remain embedded in the cord to make it luminescent even though a portion of the paint dried on the surface of the cord may flake off as the welt is being assembled.

Immediately after the initial drying of the phosphorescent paint, the cord 12 is then encased within the strip 11 to form the welt 10. Provided a tight-fitting enclosure is promptly formed about the cord 12, the paint will retain its flexibility and its capacity to phosphoresce for substantially greater periods of time than if the paint, once dried, were left exposed to the atmosphere. I have found that phosphorescent paint on a cord 12 without any protective enclosure flakes and no longer exhibits significant luminescence within six to twelve months whereas the same paint on a cord 12 protected by a close-fitting strip 11 remains flexible and continues to generate useful levels of luminous flux for over one and a half years. The lifetime of the phosphors within the paint is further extended by heat sealing the ends 18 of the welt 10 once it has been cut to length for a particular application (FIG. 3). Moreover, the relatively thick walls of the strip 11 provide ample protection for children or pets that might chew on a welt 10 attached to a piece of upholstery as well as shield the cord 12 from abrasion due to normal wear even when the welt is installed along the edge of a carpet 16.

Several compositions of luminous paints are widely known which are suitable for use in the welt 10. Preferred paints includes mixtures of a zinc sulfide phosphor, i.e., zinc sulfide in which an activator such as copper or silver is incorporated at extremely low concentrations, with acrylic resin as a vehicle, denaturated alcohol as a solvent, and aluminum stearate as a suspending agent. Alternately, mixtures of a zinc sulfide phosphor with latex as a vehicle and water as a solvent can be used. The paint preferably has a slight greenish-yellow pigmentation because such paints are among those with the brightest phospborescence. No radioactive materials are utilized in making these paints; and their ingredients in general have a low toxicity, according to Strobolite Co., Inc., manufacturer of Strobolite Luminous Acrylic and Latex Paints. A paint mixture with an acrylic vehicle but having an alkaline earth phosphor other than zinc sulfide which could be modified by replacing its alkaline earth phosphor with a zinc sulfide one to obtain a preferred phosphorescent paint is described in U.S. Pat. No. 2,436,182.

I have found that one gallon of luminous acrylic paint costing approximately $150.000 is sufficient to saturate up to 8 spools or 2000 yards of 2-ply cotton thread at an average cost for the paint alone of about 2.5 cents per linear foot. A sharp reduction in the costs normally associated with decorating with phosphorescent paints is brought about in the case of the welt 10 because of its thick-walled but long-lived strip 11 protecting the chemical composition and flexibility of the paint saturating the cord 12.

Although the welt 10 will phosphoresce for a few hours after being exposed to the light from an ordinary match for a few seconds, the welt phosphoresces most intensely after receiving a higher dosage of light radiation. Because the brightness of the phosphorescent paints are very low in any situation, the welt 10 is best viewed in total darkness. The exponential decay in its brightness after any light falling on it has been extinguished is compensated in part by the capacity of the human eye to adapt to darkness. Because this dark adaptation reaches its full value only an hour after the eye has been exposed to bright light, a person coming from a brightly illuminated room into the dark perceives the ever decaying intensity of the light from the welt 10 to grow brighter during the first minutes and afterwards for quite a time to decay less strongly than is the actual situation.

In the preferred embodiment of the invention, phosphorescent paints which glow after an exciting light source has been removed are mentioned. However, fluorescent materials which glow while being excited by light of a suitable wavelength may also be used.

By the term "luminescent" which is used in the foregoing specification and in the appended claims is meant that property of a material which causes visible light to be emitted after an exciting light source has been removed as well as that property of a material to glow under a source of light of low visibility and suitable wavelength such as an ultraviolet light source.

What is claimed is:

1. A welt comprising:

(a) a cord saturated with a luminescent paint; and (b) a strip of flexible, transparent plastic material, one of the longer edges of the strip being first folded over the cord and then joined to a portion of the strip contiguous with the cord along the entire length thereof, the inner wall of the strip being movable relative to the cord while forming a close-fitting enclosure about the cord, so that the strip can be stretched generally independently of the cord, the enclosure being formed about the cord immediately after a cursory drying of the luminescent paint with which the cord is saturated, so as to help preserve the flexibility and chemical composition of the paint.

2. A welt according to claim 1 which is further characterized as being adapted to be attached to a piece of upholstery, the strip extending from said portion thereof contiguous with the cord a distance which is substantially greater than the thickness of the cord, so that the strip can be so attached.

3. A welt comprising:

(a) a cord of natural fiber in which is embedded a luminescent material, the capacity for luminescence of said material deteriorating much more rapidly upon exposure of said material to oxidizing agents within the atmosphere than when said material is not so exposed; and (b) a strip of thick-walled, but flexible, translucent plastic material, one of the longer edges of said strip being first folded over the cord and then joined to a portion of the strip contiguous with the cord along its entire length, the inner wall of the strip being movable relative to the cord, so that the strip can be stretched generally independently of the cord, the strip forming an enclosure about the cord, the enclosure being formed promptly about the cord after the luminescent material is embedded therein so that the luminescent material, once embedded, is not left exposed to the atmosphere, the wall of the strip being generally crack-free, so that lower concentrations of oxidizing agents are maintained proximate the cord than if the rate of interchange between the atmosphere and any gases evaporating from the luminescent material were unimpeded by said wall, so as to help preserve said capacity for luminescence.

* * * * *